US006926600B1

(12) United States Patent
Arnold, Jr.

(10) Patent No.: US 6,926,600 B1
(45) Date of Patent: Aug. 9, 2005

(54) CHIMNEY CAP APPARATUS AND METHOD

(75) Inventor: John G. Arnold, Jr., Tulsa, OK (US)

(73) Assignee: European Copper, LLC, Tulsa, OK (US)

( * ) Notice: Subject to any disclaimer, the term of this patent is extended or adjusted under 35 U.S.C. 154(b) by 0 days.

(21) Appl. No.: 10/847,418

(22) Filed: May 17, 2004

(51) Int. Cl.[7] ..... F23J 13/08
(52) U.S. Cl. ..... 454/12; 454/40
(58) Field of Search ..... 454/12, 13, 14, 454/35, 39, 40

(56) References Cited

U.S. PATENT DOCUMENTS

| | | | | | |
|---|---|---|---|---|---|
| 638,172 | A | * | 11/1899 | Burress | 454/12 |
| 847,255 | A | | 3/1907 | Kobusch | |
| 1,627,105 | A | | 5/1927 | Meier | |
| 1,644,701 | A | * | 10/1927 | Anderson | 454/12 |
| 2,381,178 | A | | 8/1945 | Munyon | 72/88 |
| 2,763,196 | A | | 9/1956 | Singleton | |
| 3,269,296 | A | | 8/1966 | Best | |
| 3,817,162 | A | | 6/1974 | Guelph | |
| 4,286,975 | A | | 9/1981 | Whiteley | 55/269 |
| 4,732,078 | A | | 3/1988 | Giumenta et al. | |
| D299,529 | S | | 1/1989 | Best | D23/373 |
| 5,125,198 | A | | 6/1992 | Giumenta et al. | 52/218 |
| 5,402,613 | A | | 4/1995 | Giumenta et al. | 52/244 |
| 6,152,817 | A | * | 11/2000 | Daniels et al. | 454/12 |

FOREIGN PATENT DOCUMENTS

| | | | | |
|---|---|---|---|---|
| FR | 0655171 | * | 12/1928 | 454/40 |
| GB | 0002653 | * | 2/1884 | 454/40 |
| GB | 0011221 | * | 2/1910 | 454/40 |

* cited by examiner

*Primary Examiner*—Harold Joyce
(74) *Attorney, Agent, or Firm*—Head, Johnson & Kachigian

(57) ABSTRACT

A cap for a flue opening of a chimney in order to enhance draw of smoke and in order to protect from entry of animals and debris. The device includes sidewalls fabricated from flat sheet metal and a top attached to the sidewalls from fasteners. A plurality of louver openings are provided in the sidewalls in order to draw air. A plurality of exit vent openings in the sidewalls above the louver openings are at least equal to a cross-sectional area of the flue opening. An inner frame and mounting assembly includes a mechanism to both anchor the device to the chimney flue and to level the device.

10 Claims, 3 Drawing Sheets

CHIMNEY CAP APPARATUS AND METHOD

BACKGROUND OF THE INVENTION

1. Field of the Invention

The present invention is directed to a cap for a flue opening of a chimney. In particular, the present invention is directed to a cap for a flue opening which extends the chimney in order to enhance draw of smoke, protect from the elements (such as rain, snow, and wind) and from entry of animals and debris, and provide a decorative external feature for a building.

2. Prior Art

Chimneys for houses and other buildings typically include a flue liner in a chimney which carries the smoke and exhaust upward to be disbursed into the atmosphere. Various caps have been proposed in the past to prevent rain and other elements from entering the opening of the flue. Various prior chimney caps also have been utilized to extend the length of the chimney. By way of example, Munyon (U.S. Pat. No. 2,381,178) provides a chimney extension formed of sheet metal secured by rivets 9 and clamps 10 having brackets 11 or 15. Past chimney caps also have been designed to prevent entry of debris or small animals into the chimney flue.

Various chimney caps in the past have been constructed of clay and masonry. While functional and decorative, they are extremely heavy and difficult to move to a roof top.

Also by way of example, Giumenta et al. (U.S. Pat. Nos. 4,732,078 and 5,402,613) disclose a chimney cap with four perforated sides formed from a flat metal blank. Flanges are used to attach to the chimney and a roof may be welded to the perforated sides of the chimney cap.

Notwithstanding the foregoing, there remains a need for a lightweight, decorative chimney cap that may be attached to a chimney with minimal effort and that may be adjustable in order to level the cap to the particular application and in order to permit easy removal if necessary.

There remains a need to provide a lightweight, decorative chimney cap that may be manufactured inexpensively without welding.

There remains a need to provide a lightweight, decorative chimney cap without clay or masonry that may be easily moved to the top of a roof.

SUMMARY OF THE INVENTION

The present invention provides a chimney cap apparatus or device to be installed over a flue opening of a chimney. The device includes a plurality of planar sidewalls fabricated from flat sheet metal. The sidewalls may be fabricated from two flat metal sheets, each flat metal sheet comprised of four panels each. The two sheets are brought together and joined at their seams.

Each sidewall panel may include a plurality of louver openings stamped or otherwise made into the sidewalls. Each louver opening faces upward away from the chimney. At the top of each sidewall panel, opposed to the louver openings are a plurality of exit openings. The total area of the exit openings is at least equal to the cross-sectional area of the flue opening.

A top is attached to the upper end of the sidewalls and may also be fabricated from flat sheet metal.

An inner frame and mounting assembly includes a mechanism to both anchor the device to the chimney and to level the device with respect to the chimney. The assembly includes a series of L-brackets fabricated from metal which is non-reactive and compatible with the sidewall flat sheet metal.

The mounting assembly also includes a plurality of clips which are receivable in receptacles in the L-brackets of the inner frame and mounting assembly. One side of the clip includes an opening for receiving a fastener which will be connected to the chimney. Each clip also includes an elongated slot which receives a fastener such as a bolt which would pass through the slot and through an opening in the sidewall. Accordingly, by adjusting the positioning of the fastener in the slot, the clip may be utilized to adjust the level of the device with respect to the chimney.

The device also includes a pair of parallel, continuous internal brace rings which are parallel to the L-brackets of the inner frame and mounting assembly. Internal corner braces supplement the stability and assist in joining together the sidewalls.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
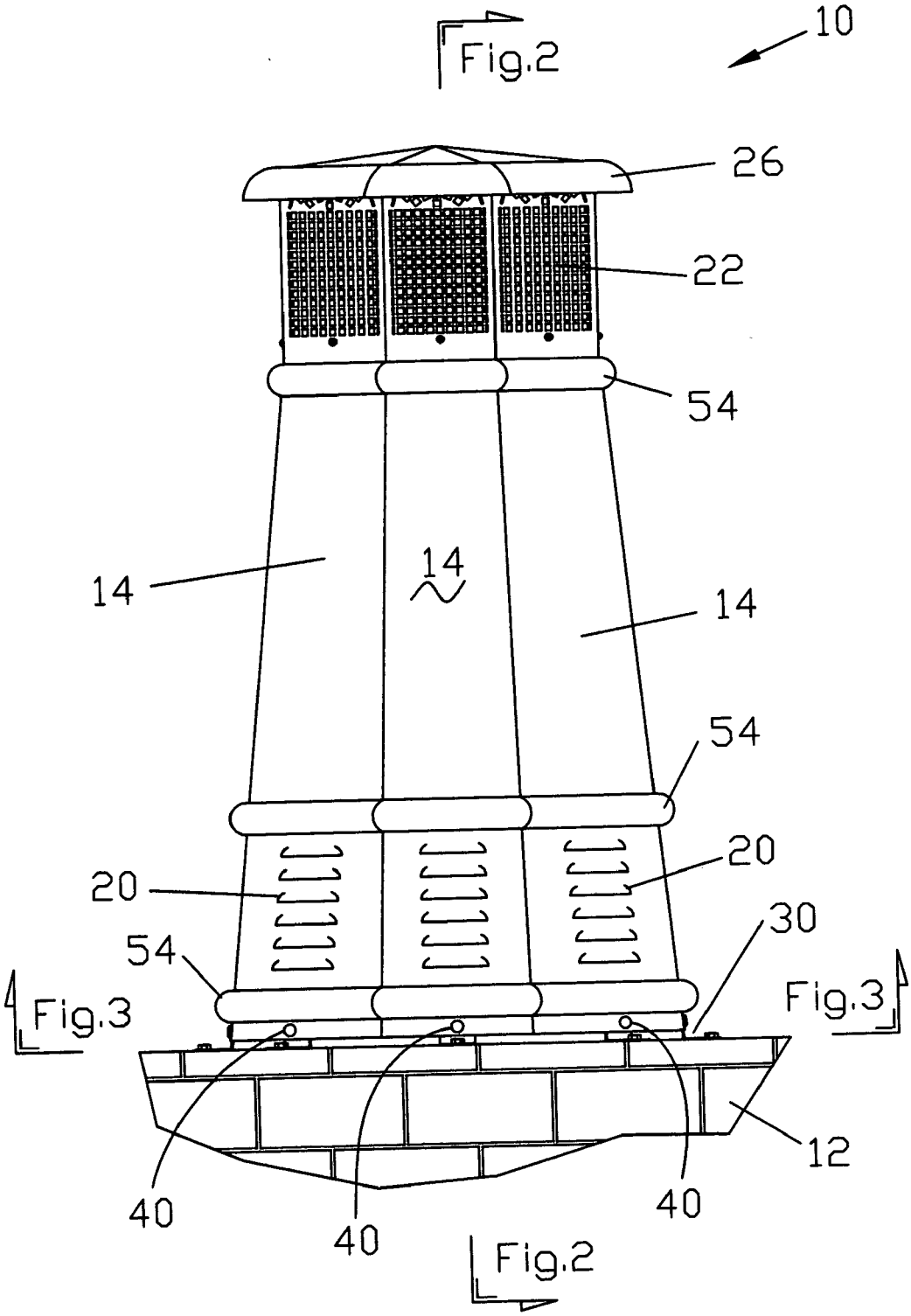
FIG. 1 is a plan view of a chimney cap apparatus attached to a chimney as constructed in accordance with the present invention.

Referring to the drawings in detail, FIG. 1 illustrates a plan view of a cap apparatus or device 10 constructed in accordance with the present invention. The cap device is installed over a flue opening of a chimney 12, a portion of which is shown in FIG. 1. The device 10 would sit at the top of the chimney 12 and surround a flue opening (not visible). The device may be mounted on chimneys of various materials and configurations.

The device 10 includes a plurality of planar sidewalls which are fabricated from flat sheet metal. In the present embodiment, the sidewalls form an octagon and are truncated so to narrow moving away from the chimney toward the top. It will be understood that the device may have a cross-section in the form of a hexagon, square or other configuration within the spirit and scope of the present invention.

Figure 2:
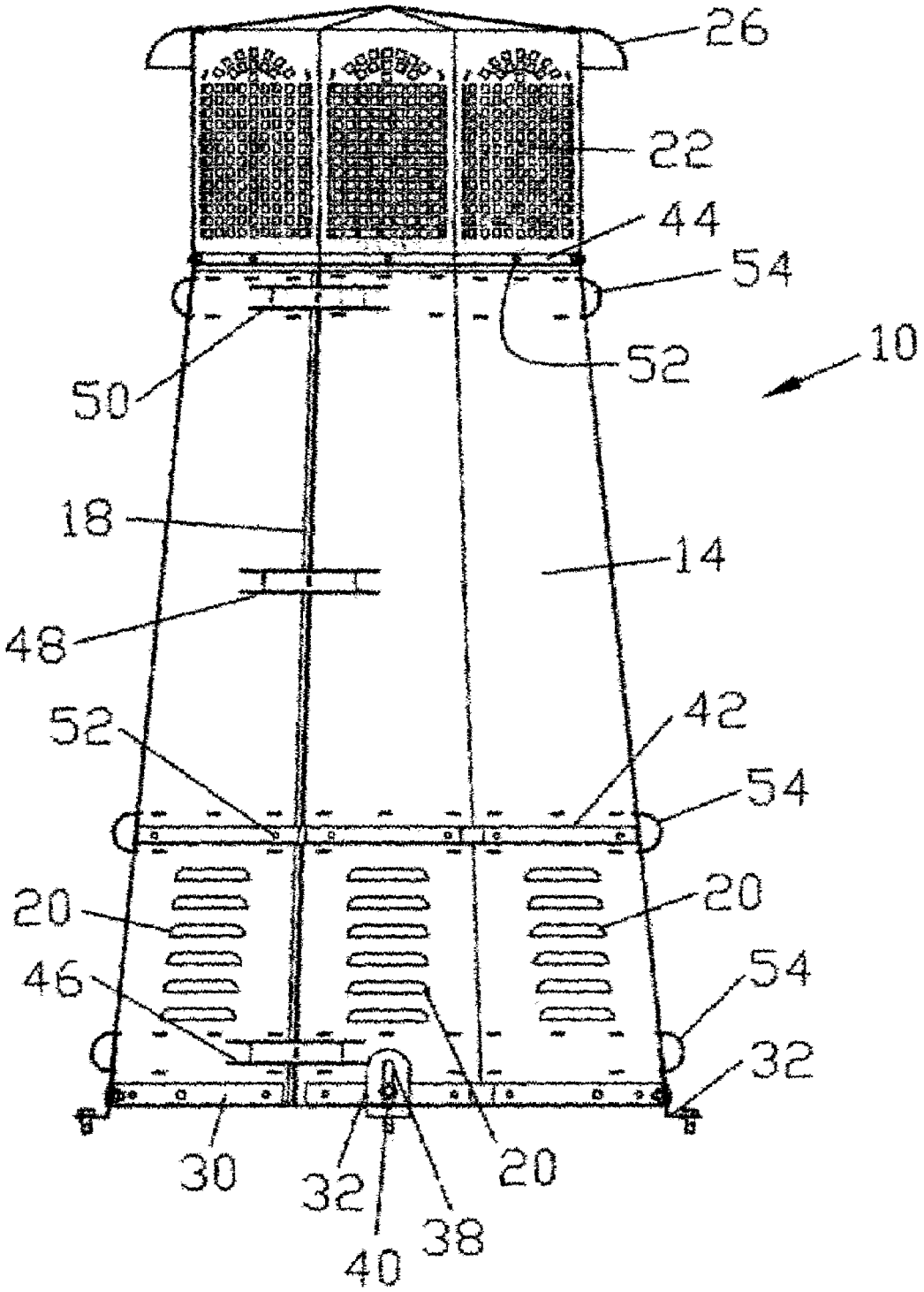
FIG. 2 is a sectional view of the chimney cap shown in FIG. 1 taken along section line 2—2 of FIG. 1 apart from the chimney.

FIG. 2 illustrates a sectional view of the device 10 taken along section line 2—2 of FIG. 1 apart from the chimney. The sidewalls 14 may be fabricated from two flat metal sheets, each flat metal sheet comprised of four panels each. The two sheets are then brought together and joined at seams 18. Each sidewall panel may include a plurality of louver openings 20 which are stamped, punched, formed or otherwise made into the sidewalls 14. Each louver opening 20 faces upward away from the chimney in the direction of the exiting smoke.

At the top of each sidewall panel, opposed to the louver openings are a plurality of exit openings 22 in the sidewalls. The exit openings 22 are stamped, punched, formed or otherwise made into the sidewalls. Each exit opening 22 is relatively small and would not allow for birds, squirrels, or other small animals to crawl therethrough. The exit openings 22 are provided so that the total area of the exit openings is at least equal to the cross sectional area of the flue opening and, in a preferred embodiment, is greater than the cross sectional area of the flue opening.

A top 26 is attached to the upper end of the sidewalls. The top 26 may also be fabricated from flat sheet metal. In the embodiment shown, the outer edge of the top is slit and the top is then rolled or pressed.

In the present embodiment, the sidewalls 14 and the top 26 are fabricated from copper metal which is decorative and lightweight but relatively soft.

The device 10 also includes an inner frame and mounting assembly 30. The assembly 30 includes a mechanism to both anchor the device 10 to the chimney and to level the device with respect to the chimney. As best seen in FIG. 2, the assembly 30 includes a series of L-brackets fabricated from metal which is non-reactive and compatible with the sidewall flat sheet metal. In the present preferred embodiment, the sidewalls are copper and the inner frame mounting assembly is constructed of stainless steel.

Figure 3:
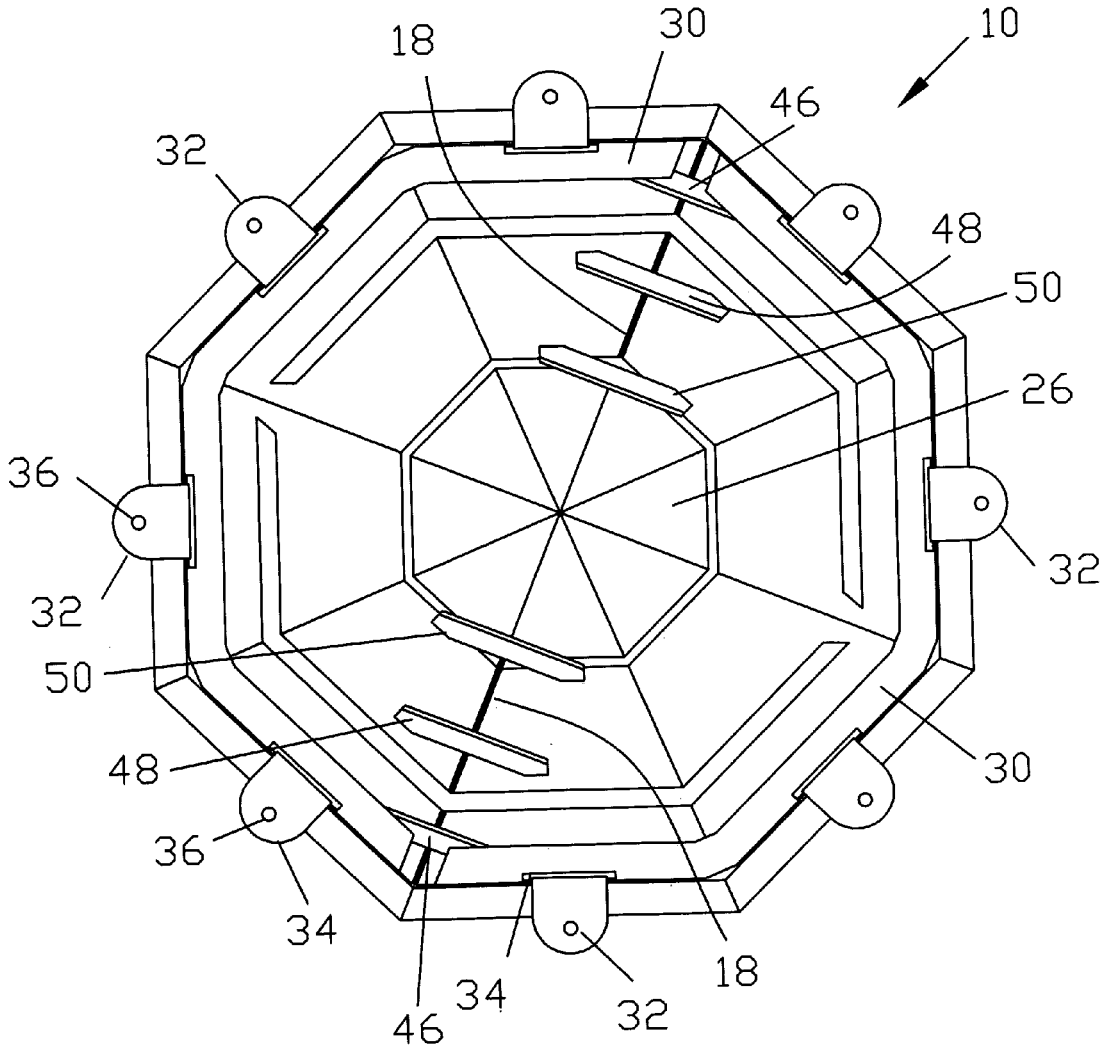
FIG. 3 is a bottom view of the chimney cap apparatus shown in FIG. 1 taken along section line 3—3 of FIG. 1.

The mounting assembly also includes a plurality of clips 32. FIG. 3 illustrates a bottom view of the device taken along section line 3—3 of FIG. 1. Each clip 32 is receivable in a receptacle 34 in the L-brackets. One side of the clip includes an opening 36 for receiving a fastener which will be connected to the chimney 12.

As best seen in FIG. 2, each clip 32 also includes an elongated slot 38 which receives a fastener 40, such as a bolt, which will pass through the slot 38 and through an opening in the sidewall 14 of the device. Accordingly, by adjusting the positioning of the fastener 40 in the slot 38, the clip 32 may be used to adjust the level of the device with respect to the chimney 12.

The device 10 also includes a pair of parallel, internal brace rings 42 and 44. The brace rings are parallel to the L-brackets of the inner frame 30. The continuous internal brace rings 42 and 44 may also be fabricated from L-shaped stainless steel or other metal which is compatible and non-reactive to the sidewalls and be attached by fasteners such as screws or rivets 52 to the sidewalls 14.

As best seen in FIGS. 2 and 3, the sidewall panels are joined together by internal corner braces 46, 48 and 50. The corner braces 46, 48 and 50 may be held to the sidewalls by tabs and slots.

Finally, semi-cylindrical molding 54 may be fastened to the sidewalls 14 both as a decorative feature and to hide the fasteners for the internal brace rings as best seen in FIG. 2. The edges of the molding terminates in extending tabs which are receivable in slots punched in to the sidewalls. Once inserted, the tabs are twisted to lock in place.

The entire device may be fabricated without welding, which eliminates undesirable weld marks and which is easy to manufacture.

In order to manufacture or fabricate the device 10, a pair of flat metal plates are fabricated by punching and folding so that each sheet forms four panels. The two sheets are then brought together and joined at the seams 8 so that a truncated octagon is formed. During the stamping process, the louver openings 20 and the exit openings 22 are stamped into the sidewalls.

Additionally, a top 26 is fabricated from flat sheet metal by stamping and folding or rolling. The top is connected to the sidewalls by fasteners such as rivets. The inner frame and mounting assembly 30 is attached to the sidewalls 14 by rivets. Additionally, the pair of continuous internal inner brace rings 42 and 44 are attached to the sidewalls by rivets.

The tabs on the moldings 54 are inserted into slots in the sidewalls and the tabs on the moldings are twisted in order to lock the moldings in place.

The assembled device 10 is lightweight and may be moved to a rooftop for attachment to the chimney 12 using the clips 32.

Whereas, the present invention has been described in relation to the drawings attached hereto, it should be understood that other and further modifications, apart from those shown or suggested herein, may be made within the spirit and scope of this invention.

What is claimed is:

1. A cap device for a flue opening of a chimney to enhance draw of smoke and to protect from entry of animals and debris, which device comprises:

sidewalls fabricated from flat sheet metal forming a tubular housing;

a top attached to said sidewalls by fasteners;

a plurality of louver openings in the lower portion of said sidewalls to draw air;

a plurality of exit openings in the upper portion of said sidewalls above said louver openings wherein said exit openings are at least equal to a cross-sectional area of said flue opening; said side wall having an imperforated portion between said lover and upper portion;

an inner frame and mounting assembly attached to the lower edge of each sidewalls; and anchoring and leveling means to anchor said inner frame and mounting assembly to said chimney and to level said device with respect to said chimney.

2. A cap device as set forth in claim 1 wherein said inner frame and mounting assembly is fabricated from L-bracket metal which is non-reactive and compatible with said sidewall flat sheet metal.

3. A cap device as set forth in claim 2 wherein said sidewalls and top are copper and said inner frame and mounting assembly are stainless steel.

4. A cap device as set forth in claim 1 wherein said inner frame and mounting assembly includes receptacles, said anchoring and leveling means includes a plurality of clips attachable to said chimney wherein said clips are receivable in said receptacles in said inner frame and mounting assembly of said device.

5. A cap device as set forth in claim 4 wherein each said clip includes an elongated slot to adjust said level of said device.

6. A cap device as set forth in claim 1 including a plurality of continuous brace rings spaced along the internal surface of said housing.

7. A cap device as set forth in claim 6 including a pair of said brace rings parallel to each other.

8. A cap device as set forth in claim 1 wherein said sidewalls include discreet panels joined by internal corner braces.

9. A cap device as set forth in claim 1 wherein said housing has a cross-section in a form chosen from the group consisting of an octagon, a hexagon, a square or a rectangle.

10. A cap device for a flue opening of a chimney to enhance draw of smoke and to protect from entry of animals and debris, which device comprises:

sidewalls fabricated from flat sheet metal forming a tubular housing;

a top fabricated from flat sheet metal attached to said sidewalls by fasteners;

a plurality of louver openings facing said top stamped in the lower portion of said sidewalls to draw air;

a plurality of exit openings stamped in the upper portion of said sidewalls above said louver openings wherein said exit openings are at least equal to a cross-sectional area of said flue opening; said side wall having an imperforated portion between said lower and upper portion;

an inner frame and mounting assembly including receptacles, a plurality of clips attachable to said chimney, wherein said clips are receivable in said receptacles in said inner frame and mounting assembly wherein each said clip includes one side which fastens to said chimney and another side which includes an elongated wherein fasteners pass there through, slot to both anchor said device to said chimney and to level said device; and a plurality of continuous brace rings spaced along the internal surface of said housing.

* * * * *